US005276460A

United States Patent [19]

Miyajima

[11] Patent Number: 5,276,460

[45] Date of Patent: Jan. 4, 1994

[54] SKEW PREVENTER FOR A FILM BELT

[75] Inventor: Kunio Miyajima, Tokyo, Japan

[73] Assignee: NEC Corporation, Tokyo, Japan

[21] Appl. No.: 975,735

[22] Filed: Nov. 13, 1992

[30] Foreign Application Priority Data

Nov. 14, 1991 [JP] Japan ..... 3-326526

[51] Int. Cl.[5] ..... B41J 35/08

[52] U.S. Cl. ..... 346/76 PH; 400/579; 400/619; 226/15; 226/17; 226/21; 226/23

[58] Field of Search ..... 346/76; 400/579, 619; 226/15, 17, 21, 23

[56] References Cited

U.S. PATENT DOCUMENTS 4,174,171 11/1979 Hamaker et al. ..... 226/23
4,835,567 5/1989 Okushi et al. ..... 226/17
4,901,903 2/1990 Blanding ..... 226/21

FOREIGN PATENT DOCUMENTS 0547060 10/1957 Canada ..... 226/21
2407842 8/1975 Fed. Rep. of Germany ..... 226/21
0033168 2/1986 Japan ..... 400/579
0222771 10/1986 Japan ..... 400/579

*Primary Examiner*—Benjamin R. Fuller
*Assistant Examiner*—Huan Tran
*Attorney, Agent, or Firm*—Sughrue, Mion, Zinn, Macpeak & Seas

[57] ABSTRACT

A thermal printer of the type applying ink to an endless film belt, selectively melting the ink by a thermal head in response to an image signal, and transferring the melted ink to a recording medium to print an image on the medium. An idler guides the film belt while applying a predetermined tension thereto. A tension adjusting mechanism moves the end of the idler toward which the belt has skewed in the running direction of the belt. The idler and tension adjusting mechanism effectively reduce the local increase in the tension of the film belt.

3 Claims, 4 Drawing Sheets

SKEW PREVENTER FOR A FILM BELT

BACKGROUND OF THE INVENTION

The present invention relates to a thermal printer for printing image data on a paper or similar printing medium by thermal transfer. More particularly, the present invention is concerned with a thermal printer of the type applying hot melt ink, powdery toner or similar thermally meltable ink to an endless film belt being rotated, selectively melting the ink by a thermal head in response to a signal representative of image data, and transferring the melted ink to a recording medium to print the image data on the medium.

A thermal printer of the type described has a reservoir storing thermally meltable ink therein. The ink is liquefied by heat and supplied from the reservoir to the surface of a film belt via an inking member implemented as a drum. While the film belt is moved toward a thermal head, the ink deposited thereon is cooled and solidified. The thermal head melts the ink in response to an image signal sent from a control circuit, thereby transferring the ink from the film belt to a print paper or similar recording medium. This type of thermal printer has a problem in that while the transfer of the ink from the film belt to a print paper is repeated, the film belt is apt to skew due to the local error in the balance of the tension acting on the film belt. The local error is ascribable to various causes including the different degrees of parallelism of rollers constituting a belt drive mechanism, the different circumferential lengths of the rollers, and the slippage and mechanical stretch of the film belt.

To prevent the film belt from skewing, Japanese Utility Model Publication No. 19247/1990 discloses a device including a sensor responsive to the skew of the film belt, a solenoid operated by the output signal of the sensor, and a correction roller to be moved by the solenoid. However, this kind of implementation is not practicable without resorting not only to the sensor, solenoid and other mechanically movable parts but also to electric circuitry for driving them, complicating the construction and increasing the cost of the printer.

SUMMARY OF THE INVENTION

It is, therefore, an object of the present invention to provide a thermal printer capable of effectively preventing a film belt thereof from skewing and thereby insuring stable printing with a simple and inexpensive construction.

In accordance with the present invention, a thermal printer for printing image data on a recording medium by selectively melting ink applied to a surface of a film belt being moved by a thermal head in response to the image data, and transferring the melted ink to the recording medium comprises an idler guiding the film belt while applying a predetermined tension to the film belt, and a tension adjusting mechanism for adjusting, when the film belt in movement skews, the tension being exerted by the idler on the skewed side of the film belt to thereby correct the skew.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
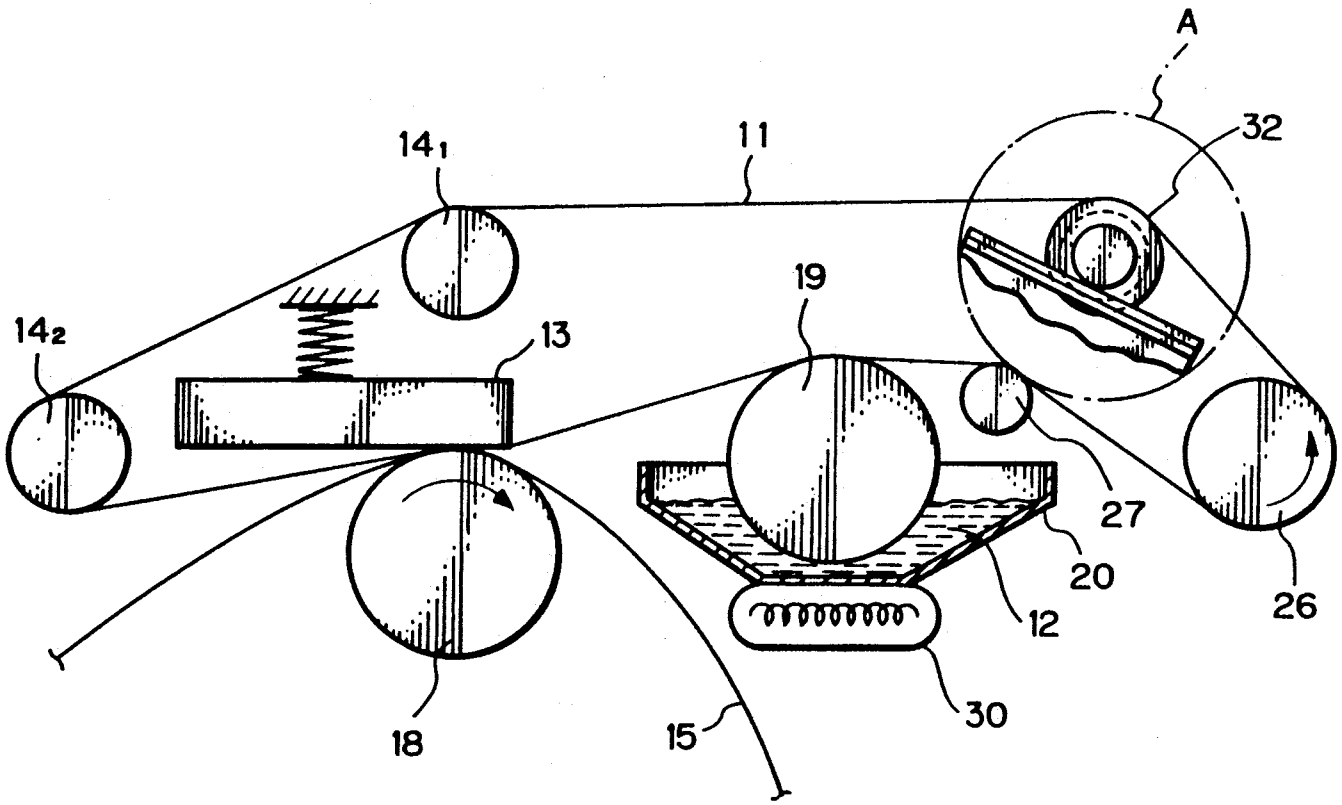
FIG. 1 is a section of a thermal printer embodying the present invention.
Figure 2:
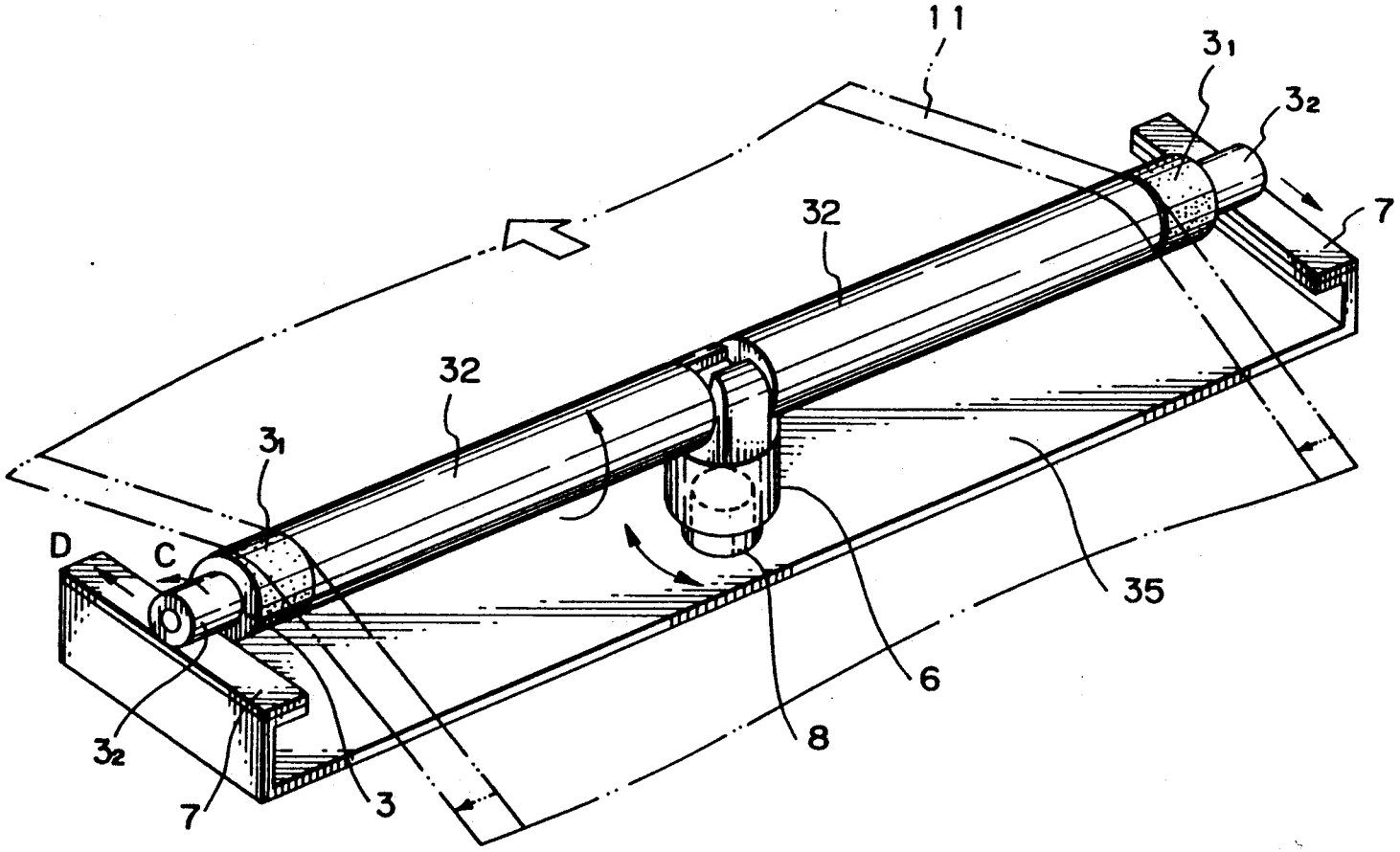
FIG. 2 is a perspective view showing a specific configuration of an idler and members associated therewith included in the embodiment.
Figure 3:
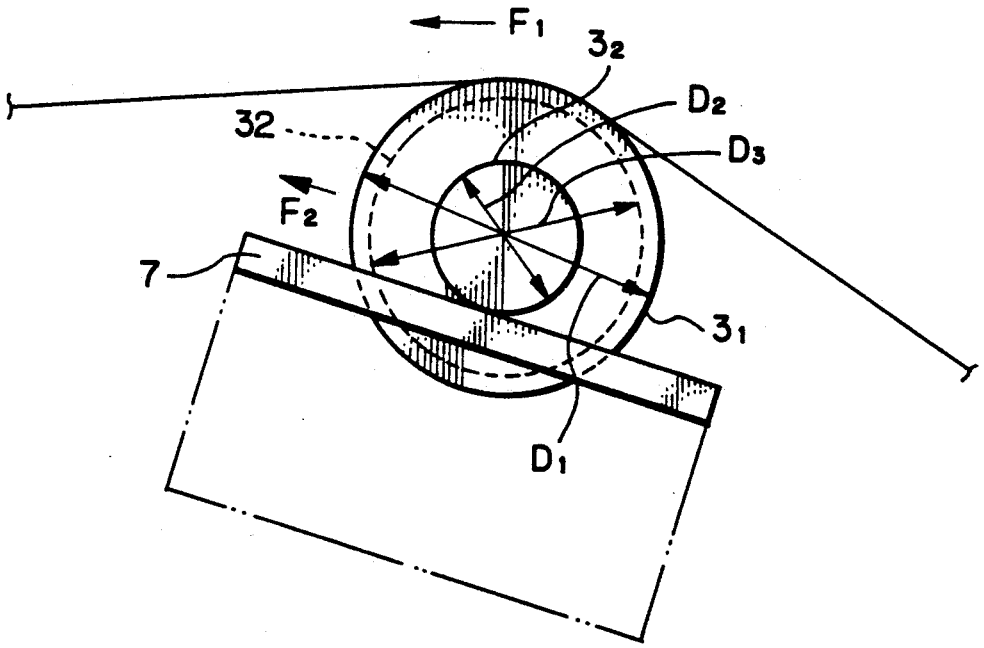
FIG. 3 is a view demonstrating the operation of the idler.

Referring to FIGS. 1-3 of the drawings, a thermal printer embodying the present invention is shown which is of a line type and includes a reinking mechanism. As shown in FIG. 1, the thermal printer includes a reservoir 20 implemented by an aluminum member and storing ink 12 therein. A heater 30 is associated with the reservoir 20 for liquefying the ink 12 by heat. An endless film belt 11 is made of polyimide, polyamide or similar heat-resistive substance. An inking member in the form of a drum 19 is so positioned as to supply the liquefied ink 12 continuously to the surface of the film belt 11. A thermal head 13 transfers the ink 12 from the film belt 11 to a print paper or similar recording medium 15 by heating it. A platen roller 18 is located to face the thermal head 13. A capstan roller 26 drives the film belt 11. An idler roller, or simply idler, 32 guides the film belt 11 being driven by the capstan roller 26 and applies a predetermined degree of tension to the film belt 11. Guide rollers $14_1$ and $14_2$ also guide the movement of the film belt 11. A regulating member 27 regulates the ink 12 applied to the film belt 11 by the drum 19 to a predetermined thickness.

In operation, the ink 12 applied to the film belt 11 and regulated by the regulating member 27 is cooled and solidified and transported to the head 13 by the film belt 11. While the inked surface of the film belt 11 and one side of the print paper 15 sequentially overlap each other, the thermal head 13 located at the rear of the film belt 11 has heating elements thereof, not shown, selectively energized in response to an image signal or drive signal. As a result, the ink 12 on the film belt 11 is transferred to the print paper 15 to form a desired image, i.e., a text image or a graphic image. In this manner, in the illustrative embodiment, the film belt 11 is constantly driven by the capstan roller 26 along the predetermined path while being guided by the guide rollers $14_1$ and $14_2$. The capstan roller 26 is rotated by a drive mechanism, not shown.

FIG. 2 shows a specific configuration of the idler 32 and members associated therewith, generally labeled A in FIG. 1. As shown, a stepped roller 3 is associated with each end of the idler 32 and made up of a larger diameter portion $3_1$ and a smaller diameter portion $3_2$. The stepped rollers 3 are rotatable coaxially with, but independently of, the idler 32, and each is made of a material having a relatively high coefficient of friction. Each smaller diameter portion $3_2$ rollably rests on a flat support plate 7 made of a material whose coefficient of friction is relatively high, e.g., rubber. The support plates 7 supporting the respective smaller diameter portions $3_2$ are affixed to opposite bent portions of an elongate flat support member 35. An idler holder 6 is rotatably mounted on a stud 8 and connected to the intermediate between opposite ends of the idler 32. In this configuration, the idler 32 is rotatable about the intermediate portion thereof over more than 2 degrees in the left-and-right direction. The film belt 11 is passed over the idler 32 over an angular distance of more than 20 degrees. As shown in FIG. 3, the diameter $D_1$ of the larger diameter portion $3_1$ and the diameter $D_2$ of the smaller diameter portion $3_2$ of each stepped roller 3 and the diameter $D_3$ of the idler 32 are held in relations $D_1 > D_2$ and $D_1 \geqq D_3$.

The thermal printer having the above construction is operated as follows.

Referring again to FIG. 1, as the film belt 11 and the print paper 15 are simultaneously driven by the platen roller 18 to the thermal head 13, the heating elements of the head 13 are selectively generated on a dot basis by a drive signal which is sent from a control circuit, not shown, and representative of a desired image. As a result, the ink 12 on the film belt 11 is melted and transferred to the print paper 15 moving through between the head 13 and the platen roller 18, printing the image on the print paper 15. After such image transfer, the film belt 11 is again brought into contact with the inking drum 19 to be supplied with the ink 12. Then, the film belt 11 is driven toward the thermal head 13 for performing the iterative image transfer.

While the transfer of the ink 12 from the film belt 11 to the print paper 15 is repeated, it is likely that the film belt 11 begins to skew due to the local error in the balance of the tension acting on the film belt 11. The local error is ascribable to various causes including the different degrees of parallelism of the rollers constituting the belt drive mechanism, the different circumferential lengths of the rollers, and the slippage and mechanical stretch of the film belt 11 apt to occur at the capstan roller 26 and platen roller 18.

In the illustrative embodiment, when the tension acting on the film belt 11 increases at one side of the belt 11 to cause it to skew, the belt 11 contacts the larger diameter portion $3_1$ of one of the stepped rollers 3 toward which it is skewing. Then, the film belt 11 exerts a rotating force on the stepped roller 3 of interest. As a result, the smaller diameter portion $3_2$ associated with the larger diameter portion $3_1$ rolls on the support plate 7 in a direction indicated by an arrow C, FIG. 2, and moves in a direction D, FIG. 2. As shown in FIG. 3, since the diameter $D_1$ of the roller portion $3_1$ is larger than the diameter $D_2$ of the roller portion $3_2$, the force $F_2$ with which the roller portion $3_2$ moves on and along the support plate 7 is greater than the force $F_1$ being exerted by the film belt 11 on the roller portion $3_1$. Consequently, the side of the idler 32 toward which the film belt 11 has skewed is sequentially angularly moved in a direction D about the idler holder 6 which is free to rotate about the stud 8. This reduces the force being exerted by the film belt 11 on the above-mentioned side of the idler roller 32 and, therefore, the more intense tension acting on the belt 11. Hence, the film belt 11 is sequentially moved toward the other side where the contact force has increased, until it fully leaves the roller portion $3_1$. In this condition, the idler 32 is supported at both ends thereof by the stepped rollers 3 which are again rotatable independently of the idler 32. As a result, the film belt 11 evenly contacts the entire idler roller 32 in the axial direction, restoring the roller 32 to the original position. The procedure described above is repeated to confine the film belt 11 in a predetermined skew range.

Figure 4:
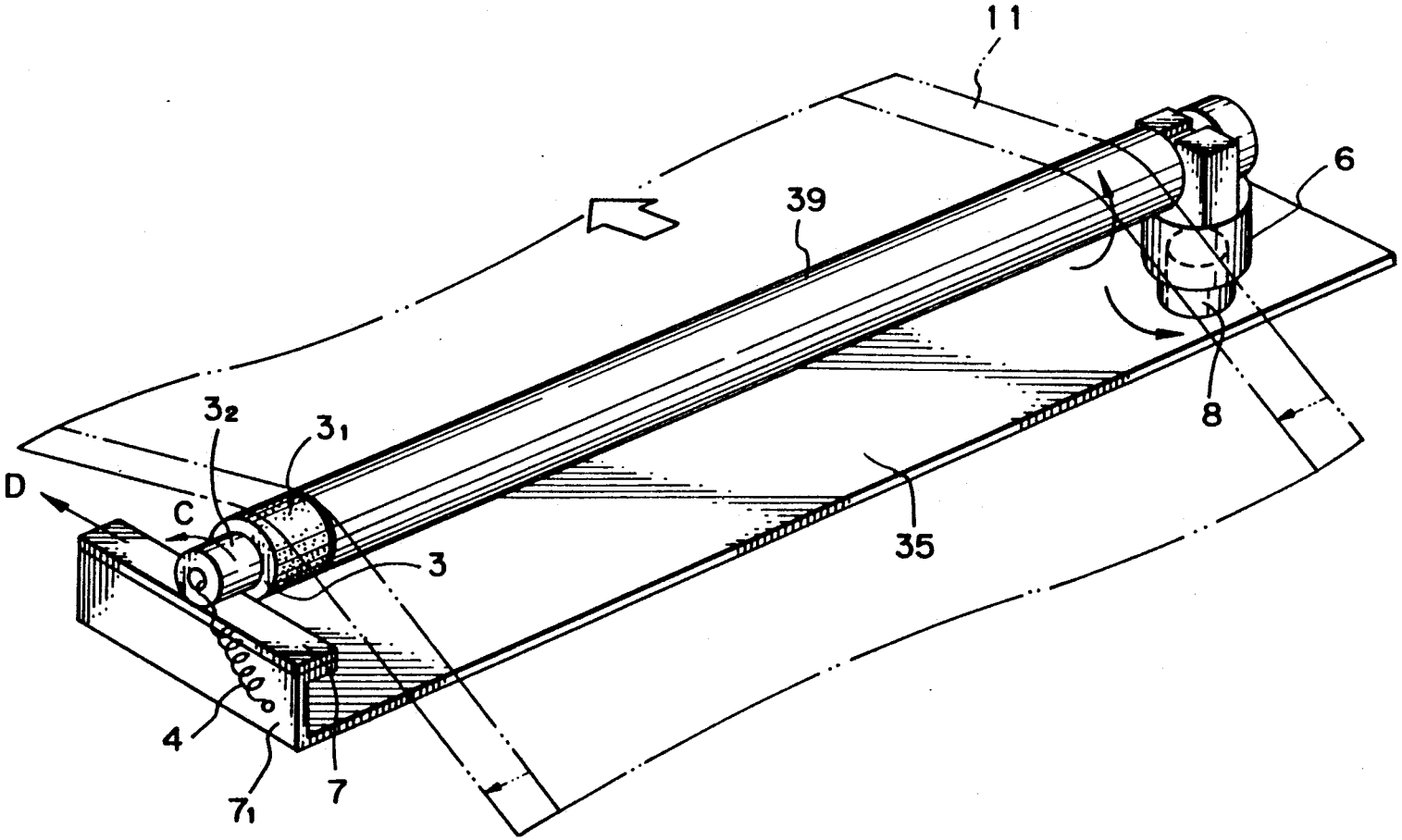
FIG. 4 is a view similar to FIG. 2, showing an alternative embodiment of the present invention.

FIG. 4 shows another specific configuration of the idler and associated members representative of an alternative embodiment of the present invention. In the figures, the same or similar constituents are designated by like reference numerals, and redundant description will be avoided for simplicity. As shown, the idler holder 6 is rotatably supported by the stud 8 and in turn supports one end of an idler 39 such that the idler 39 is pivotable about the one end. One stepped roller 3 is coaxially associated with the other end of the idler 39 and rotatable independently of the idler 39. Again, the stepped roller 3 is made up of the larger diameter portion $3_1$ and smaller diameter portion $3_2$. One support plate 7 is affixed to the bent end of the support member 35 and allows the stepped roller 3 to roll thereon. A coil spring 4 constantly exerts a predetermined tension on the end of the idler 39 which rollably rests on the support plate 7. Specifically, the stepped roller 3 movable independently of the idler 39 and the coil spring 4 constantly biasing the idler 39 in the opposite direction to the running direction of the film belt 11 are associated with the free end of the roller 39 remote from the fulcrum. The coil spring 4 is anchored at one end to the end $3_3$ of the smaller diameter portion $3_2$ of the stepped roller 3 and at the other end to part of the bent portion of the support member 35.

In operation, the coil spring 4 constantly exerts on the stepped roller 3 a predetermined tension in the direction opposite to the running direction of the film belt 11. In such a condition, the film belt 11 skews toward the free end of the idler 39 at all times. On contacting the larger diameter portion $3_1$ of the stepped roller 3, the film belt 11 exerts a rotating force on the roller 3. Then, the smaller diameter portion $3_2$ of the stepped roller 3 rolls on the support plate 7 in a direction C, causing the free end of the idler 39 to move about the idler holder 6 in a direction D. Consequently, the more intense tension developed in part of the film belt 11 adjoining the free end of the idler 39 is reduced, causing the belt 11 to move away from the larger diameter portion $3_1$ toward the idler holder 6. The procedure described above is repeated to confine the film belt in a predetermined skew range.

While the illustrative embodiments have been shown and described in relation to an idler roller, they may, of course, be applied to any other roller over which a film belt is passed. Further, the embodiments are applicable not only to a thermal printer but also to any other type of printer so long as it uses a movable film belt.

In summary, it will be seen that the present invention provides a thermal printer which surely and effectively confines a film belt thereof in a predetermined skew range with a simple and inexpensive construction. This unprecedented advantage is derived from an idler guiding the film belt while applying a predetermined tension thereto, and tension adjusting means for moving the end of the idler toward which the belt has skewed in the running direction of the belt. The idler and tension adjusting means effectively reduce the local increase in the tension of the film belt.

Various modifications will become possible for those skilled in the art after receiving the teachings of the present disclosure without departing from the scope thereof.

What is claimed is:

1. A thermal printer for printing image data on a recording medium by selectively melting ink applied to a surface of a film belt being moved by a thermal head in response to said image data, and transferring the melted ink to said recording medium, said printer comprising:

an idler guiding the film belt while applying a predetermined tension to said film belt; and tension adjusting means for adjusting the tension being exerted by said idler on a skewed side of said film belt, said tension adjusting means including at least one stepped roller associated with an end of said idler, such that when said film belt skews, said stepped roller causes the end of said idler, located on the skewed side of said film belt, to move angularly so as to correct the skew of said film belt.

2. A thermal printer for printing image data on a recording medium by selectively melting ink applied to a surface of a film belt being moved by a thermal head in response to said image data, and transferring the melted ink to said recording medium, said printer comprising:

an idler guiding the film belt while applying a predetermined tension to said film belt; and tension adjusting means for adjusting, when the film belt in movement skews, the tension being exerted by said idler on a skewed side of said film belt to thereby correct the skew, wherein said tension adjusting means comprises:

an idler holder supporting said idler such that said idler is rotatable about an intermediate portion thereof along the surface of the film belt;

a pair of stepped rollers coaxially associated with opposite ends of said idler and freely rotatable relative to said idler; and support plates each supporting a respective one of said pair of stepped rollers such that the associated stepped roller is rollable thereon.

3. A thermal printer for printing image data on a recording medium by selectively melting ink applied to a surface of a film belt being moved by a thermal head in response to said image data, and transferring the melted ink to said recording medium, said printer comprising:

an idler guiding the film belt while applying a predetermined tension to said film belt; and tension adjusting means for adjusting, when the film belt in movement skews, the tension being exerted by said idler on a skewed side of said film belt to thereby correct the skew, wherein said tension adjusting means comprises:

an idler holder located at one end of said idler and supporting said idler such that said idler is rotatable about said one end along the surface of said film belt;

a stepped roller coaxially associated with an opposite end of said idler and rotatable relative to said idler;

a support plate supporting said stepped roller such that said stepped roller is rollable thereon; and a return spring constantly biasing the opposite end of said idler in a direction opposite to a running direction of the film belt.

* * * * *